US007357728B2

(12) United States Patent
Osler-Weppenaar

(10) Patent No.: US 7,357,728 B2
(45) Date of Patent: Apr. 15, 2008

(54) HUMAN FREE-FALL SLIDE

(76) Inventor: Frederick Edward Osler-Weppenaar, 54 Puketona Road, Paihia, Northland (NZ)

( * ) Notice: Subject to any disclaimer, the term of this patent is extended or adjusted under 35 U.S.C. 154(b) by 215 days.

(21) Appl. No.: 11/162,914

(22) Filed: Sep. 28, 2005

(65) Prior Publication Data

US 2007/0072689 A1 Mar. 29, 2007

(51) Int. Cl.
*A63G 21/00* (2006.01)

(52) U.S. Cl. ..... 472/116; 472/134; 182/137

(58) Field of Classification Search ..... 472/116, 472/117, 128, 129, 134; 182/137, 139
See application file for complete search history.

(56) References Cited

U.S. PATENT DOCUMENTS

| | | | | |
|---|---|---|---|---|
| 562,448 | A | 6/1896 | Zedora | 482/26 |
| 1,166,811 | A | 1/1916 | Bowers | 182/137 |
| 1,985,432 | A | 12/1934 | Tucker et al. | 5/711 |
| 2,797,853 | A | 7/1957 | James | 227/43 |
| 2,906,366 | A | 9/1959 | Mapes | 182/39 |
| 2,975,855 | A | 3/1961 | Dudek | 182/137 |
| 3,095,947 | A | 7/1963 | Beaulaurier | 182/139 |
| 3,250,065 | A | 5/1966 | Frost | 56/329 |
| 3,310,818 | A * | 3/1967 | Fischer | 5/420 |
| 3,369,808 | A | 2/1968 | Sconce | 272/1 |
| 3,391,414 | A | 7/1968 | Gordon | 5/348 |
| 3,399,407 | A * | 9/1968 | Olsen | 482/15 |
| 3,840,922 | A | 10/1974 | Morrison et al. | 5/350 |
| 3,851,730 | A | 12/1974 | Scurlock | 182/137 |
| 4,065,124 | A | 12/1977 | Egan | 272/65 |
| 4,068,739 | A | 1/1978 | Gordon | 182/139 |
| 4,215,857 | A | 8/1980 | Gordon | 482/15 |
| 4,431,182 | A | 2/1984 | Reynolds | 482/27 |
| 4,875,548 | A * | 10/1989 | Lorsbach | 182/137 |
| 5,643,139 | A | 7/1997 | Stout et al. | 482/14 |
| 5,713,817 | A | 2/1998 | Buchanan | 482/23 |
| 5,769,725 | A * | 6/1998 | Ogden et al. | 472/59 |
| 5,772,535 | A * | 6/1998 | Murphy | 473/415 |
| 6,250,668 | B1 | 6/2001 | Breed et al. | 280/730.2 |
| 6,558,264 | B2 * | 5/2003 | Gordon | 472/117 |
| 7,210,976 | B2 * | 5/2007 | Gordon | 441/129 |

* cited by examiner

*Primary Examiner*—Kien Nguyen
(74) *Attorney, Agent, or Firm*—Louis Ventre, Jr.

(57) ABSTRACT

A slide and process of using the slide for humans' amusement, recreation and entertainment. The slide is an inflatable apparatus comprising a slide device and an airbag device. The slide device is an inflatable bag having a slide segment. The airbag device has a bottom bag separated into sections by vented baffles. The bottom bag is interconnected to top bags in the form of crumple tubess, which in turn are connected to a top cover sheet. In use, a person slides off the end of the slide segment and free falls to the airbag device.

16 Claims, 2 Drawing Sheets

HUMAN FREE-FALL SLIDE

FIELD OF INVENTION

In the field of amusement, recreation, and entertainment, the invention is an inflatable slide for humans where the lip of the end of a slide segment finishes above the ground and the participant then has a free fall into an airbag device incorporating the "crumple tubes" for enhanced safety.

DESCRIPTION OF PRIOR ART

Amusement devices employing human free falls to a net or an air-filled bag are known and regularly employed in a circus environment. The primary examples involve persons shot from a cannon into a high arc and safely falling into a net and those swinging high overhead on a trapeze and ending a performance with a fall into a net below. Movie stuntmen also perform falls off the top of a high building and often safely land in a large airbag below the camera view.

One of the deficiencies with the very large air filled bags sometimes used by stuntmen is that it takes considerable time to re-inflate them after a use. This type of bag is further of limited value in applications like a fun park environments where fast turnover is of prime importance.

One of the earliest examples of an amusement device is U.S. Pat. No. 562,448 to Zedora on Jun. 23, 1896, which discloses gymnastic apparatus wherein a gymnast is shot through the air to land in a net. While minimally satisfactory in catching an acrobat, a net is mostly limited to trained professionals because of the potential for injury.

The use of hollow inflatable cushions or mats is common in acrobatic sports and is illustrated by U.S. Pat. No. 3,840,922 to Morrison on Oct. 15, 1974, which uses two such cushions atop one another and each having a different inflated gas pressure.

U.S. Pat. No. 4,068,739 to Gordon on Jan. 17, 1978 is an example of an air cushion for jumps from high buildings. The '739 patent teaches a device useful in the evacuation of victims caught in fires of multistoried buildings, airplane crashes, or similar disasters where the normal escape routes or fire exits have been made inaccessible due to the prevailing circumstances, forcing the victims to leap from high levels to their safety. The air cushion is a large inflated enclosure. A low-pressure center chamber is circumferentially vented to a high-pressure secondary chamber. The low-pressure center chamber is intended to receive a falling person. The high-pressure chamber surrounds the center chamber and receives the pressure spike from the compression of the center chamber from the falling person. An encircling elastic band within the high-pressure chamber forces the air to immediately return to the central impact chamber. A major drawback of the '739 invention is that the person must land in the central low-pressure chamber for it to operate safely, that is with a minimum of bounce back.

The '739 invention has a number of deficiencies which are avoided in the present invention. The '739 airbag employs a design that limits the useful landing area of the airbag to the center area of a much larger airbag device, wasting much of the potential useful airbag area. The bulls-eye target center area makes it more difficult for a person to find a safe landing spot. The elastic repressurization mechanism is prone to failure. Finally, the airbag has a bounce-back or re-bound factor that makes it potentially dangerous for anyone falling outside the central area.

A varied approach was described in U.S. Pat. No. 4,431,182 to Reynolds on Feb. 14, 1984 in which separate air-filled tubes of inflated bags rise from a surface platform to form an airbag device. The '182 patent teaches an amusement device to catapult a person into free flight, safely intercept the person while in flight, decelerate the person and end the flight in an air-filled, energy absorbing deceleration device on the ground. The apparatus comprises coordinated, cooperating acceleration and retrieval means.

The present invention does not employ a catapult or an interception means as in the '182 invention. The present invention employs a unique and significantly different an air-filled, energy absorbing deceleration device on the ground, that is, an airbag device, similar in some superficial respects but significantly different from, and superior to, the '182 air-filled, energy absorbing deceleration device.

The '182 airbag device is similar to the present invention in that it employs air-filled tubes. The first major flaw of the '182 airbag device is that the tubes can separate when a falling body lands on the top surface, the body falls between the tubes and effectively gets stopped at the support base of the tubes. This flaw is a significant safety hazard.

In the '182 invention, a wall surrounds the circumference of the tubes. The wall was to theoretically hold the tubes in place and prevent them from separating. However, what happens in practice is that, unless a body lands exactly on top of a tube, the tubes separate to let the body slide past them and impact the support base. The wall surrounding the tubes helps to a degree if the unit is small enough, but it does not prevent the tubes from separating. Once the tubes immediately under impact start separating, the very fact that the tubes are designed to deform under impact allows the immediately adjacent tubes to deform sideways to give room for the continued separation of the tubes under the falling body. The present invention eliminates the wall of the '182 invention and employs a design that prevents the tube separation problem.

The wall surrounding the tubes in the '182 patent becomes useless for air bags with a large landing area. If one were to make a landing mat of about 20 meters in diameter, the outward pressure of the separating tubes is absorbed by diminishing deformation of the tubes as the ripple effect moves outwards, but this effect stops before it reaches the wall of an airbag device that size. The wall, in effect, becomes irrelevant and cannot serve any part of its intended purpose. The present invention employs a design to enable a large landing area without the attendant risk of a body falling between the tubes.

The wall system of the '182 patent becomes a safety issue when employed in other than a circular top surface. The disclosure of the '182 patent admits that a bed or airbag of any plan view shape other than circular requires rigid sidewalls to resist bending loads imposed by the inflation pressure. These rigid sidewalls introduce a danger of injury in the event that a person lands on an edge of the bed. For such applications, the 182 design would require overly-large bags, increasing the hazard of separation as described above and making such applications considerably less practical.

The present invention solves the rigid wall problem by eliminating the wall altogether and including a top sheet integrating the tubes. The top sheet both prevents a body from falling between the tubes and the integration of the top sheet with the tubes acts to pull the tubes surrounding the point of impact inwards to help support a falling body.

The '182 airbag device has no method of controlling the rate of air flow out of each individual tube into the base bag at the moment of impact. The tubes are part of the plenum underneath them. In actual use, the flow of air from the tubes is only lightly inhibited by the pressure of the inflating pump and the pressure-relief valve designed to open a vent from the plenum to the outside. Upon pressurization from the impact of a body impacting the tubes, the pump reverses to allow flow out of the plenum and the valve opens. The '182 airbag device is designed release the air escaping from the bottom of the tube into the plenum, and this in turn causes the tubes collapse too easily, allowing a falling body to impact the base plenum. Additionally, with the large hole being the direct connection to the plenum, a body impacting the base can be additionally injured by ensnaring a person's limb entering the hole.

The present solves the tube-collapsing and limb-snaring problems of the '182 airbag device by employing tubes sewn/welded onto a relatively soft base bag having a range of sizes for the connecting hole that for most applications is too small for an arm or leg to fit through. The present invention also retains the flexibility to increase or decrease the height of the crumple tubes to accommodate a fall from virtually any distance while avoiding impact with the base of the crumple tubes. Experiments on the present invention showed that even a small change of hole size from 30 mm to 50 mm has a large impact on airbag device performance. For most uses, the connecting hole will be about 50 mm or about 2 inches in diameter. However, changing the size of the connecting hole and/or increasing the height of the crumple tubes will accommodate more demanding applications, such as a falls from great heights in the stunting industry.

Finally, the '182 patent uses tension ties to hold its plenum in shape. The present invention eliminates tension ties altogether and uses baffles made of sheets of the same fabric as the base bag which runs the full width of the bag. There are holes in these sheets to allow free flow of air throughout the base bag.

The present airbag design has been tested and it solves all of the above noted flaws or problems identified above, and it works.

Accordingly, several objects and advantages of the present invention are: to provide amusement, recreation and entertainment slide combined with a human free fall and then deceleration via a safe airbag device that reduces the potential for injury to users; to provide a slide with a free fall that will not result in a person's body impacting a hard surface in the airbag device; to provide an inflatable slide that can be set up quickly; to provide a slide with an airbag device having a minimum of bounce back; to provide a slide with an airbag device that employs crumple tubes that will not separate under the weight of a person landing on the airbag device; to provide a slide with an airbag device that does not present a risk of snaring a persons limbs; to provide a slide with an airbag device that is adaptable to a human fall from virtually any height by simple changes in the size of the connecting hole or increasing the height of the crumple tubes; to provide a slide with an airbag device that has a fast turnover rate; to provide a slide with an airbag device that remains safe when deployed in any top view shape, including circular, square and rectangular; to provide a slide with an airbag device that has a useful landing area across the entire top surface area; and to provide a slide with an airbag device that will be safe for use when using large top-surface landing areas such as tens of meters or more in length, width or diameter.

It is therefore apparent that a need exists for a safe inflatable slide employing an air-filled, energy absorbing deceleration device on the ground for safer amusement, recreation, and entertainment purposes.

BRIEF SUMMARY OF THE INVENTION

The invention is a slide and process of using the slide. The slide is an inflatable apparatus comprising a slide device and an airbag device. The slide device is an inflatable bag having a slide segment. The airbag device has a bottom bag separated into sections by vented baffles. The bottom bag is interconnected to top bags in the form of crumple tubes, which in turn are connected to a top cover sheet. In use, a person slides off the end of the slide segment and free falls to the airbag device.

BRIEF DESCRIPTION OF THE DRAWING

These and additional constructional features and advantages of the invention will be more readily understood in the light of the ensuing description of a preferred embodiment thereof, given by way of example only, with reference to the accompanying drawings of the preferred embodiment.

DETAILED DESCRIPTION OF THE INVENTION

Figure 1:
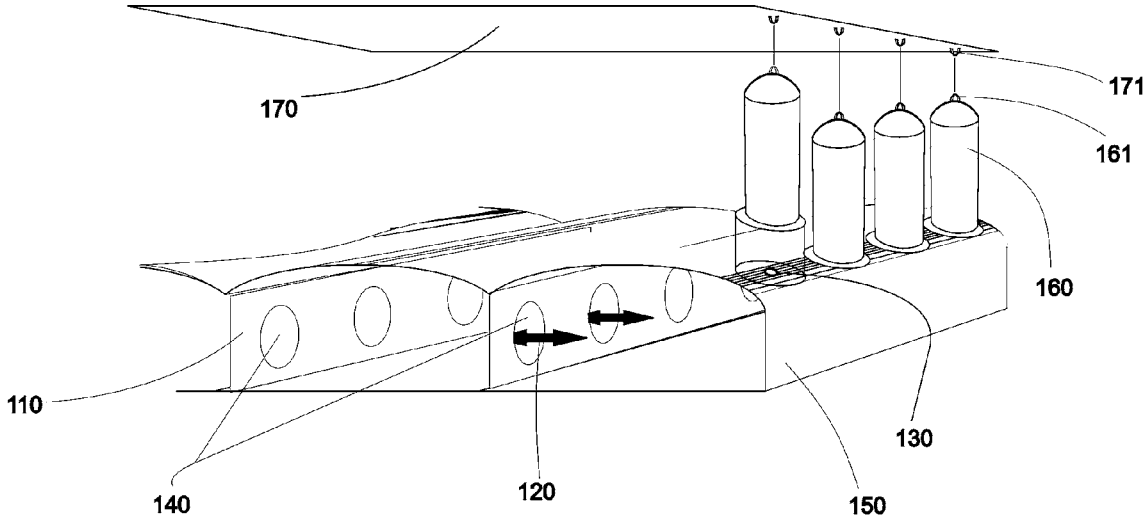
FIG. 1 is an expanded cross-sectional side view of a representative portion of an airbag device.
Figure 2:
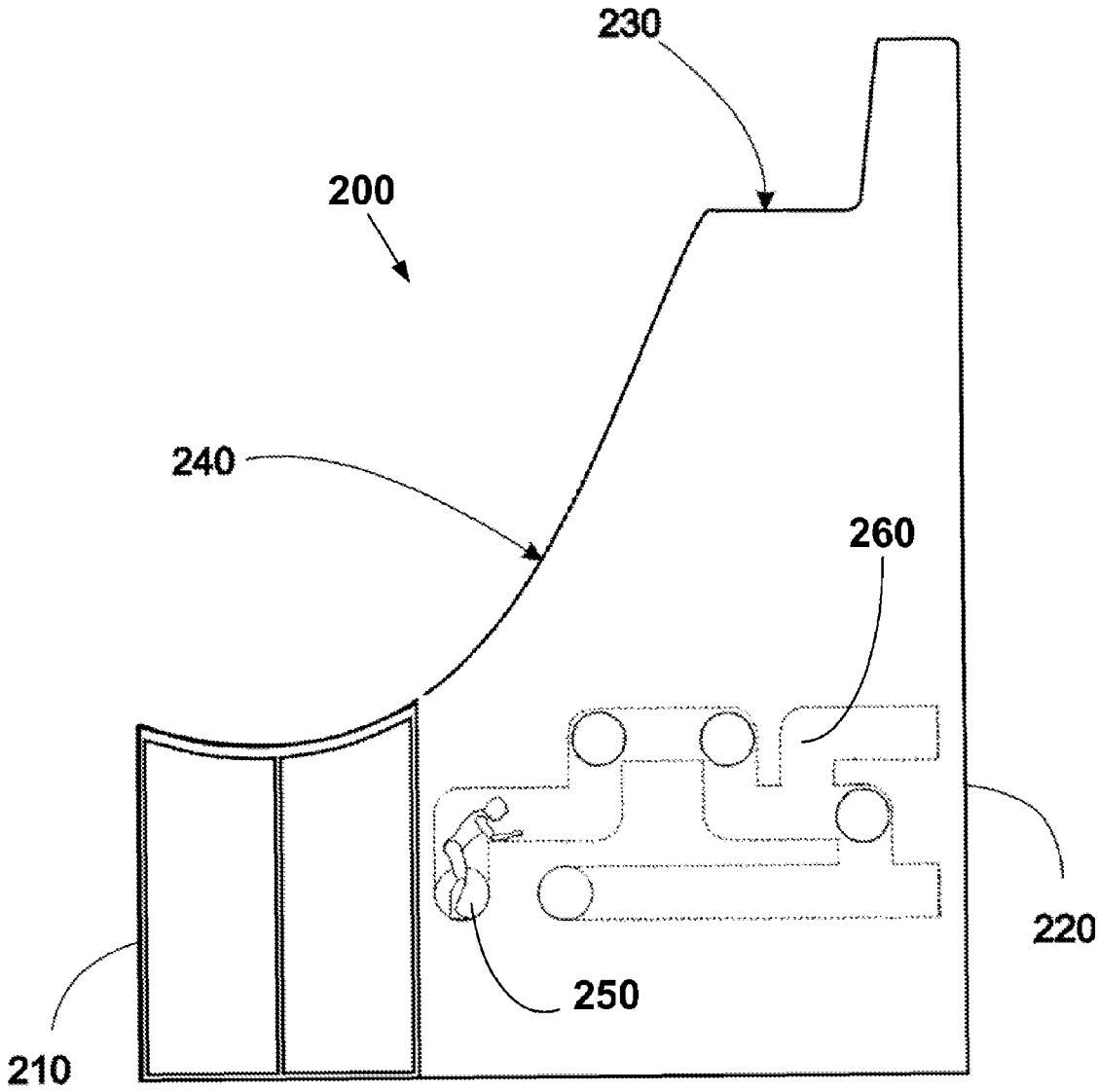
FIG. 2 is a cross-sectional side view of an inflatable slide device.

The preferred embodiment of the apparatus is an inflatable slide depicted by a combination of FIG. 1, showing the airbag device, and FIG. 2 showing the slide device.

As shown in FIG. 1, the airbag device is composed of a base bag (150). The base bag (150) is separated into sections by baffles (110), which shape the base bag (150) so that its top surface is roughly flat. Air communication (120) between the sections is sustained by vented baffles, which are essentially baffles with holes (140). At the top of the base bag are breather holes (130) to permit airflow to and from the crumple tubes (160).

The breather holes (130) further connect the base bag (150) with the crumple tubes (160) such that air pressure within the base bag maintains the crumple tubes in the extended position. The breather holes (130) may be any size appropriate to the application to provide a soft landing for a person landing on the crumple tubes (160). For most applications, the breather holes have a diameter in the range of about 20 to 50 millimeters. For the preferred embodiment, the breather holes have a diameter of about 50 millimeters.

The base bag may have any length and width and height appropriate to the application to provide a soft landing for a person landing on the device. For the preferred embodiment, the base bag is about 10 meters in length, 5 meters in width and 2 meters in inflated height. The operating pressure of the airbag is usually greater than about 0.5 pounds per square inch gauge and preferably in the range of about 2 to 3 pounds per square inch gauge. Higher pressures may be utilized to cushion falls from higher heights.

The crumple tubes (160) are air bags and are sealably attached to the base bag (150) over the breather holes (130) at the top. A single row of crumple tubes (160) is shown in FIG. 1. In the preferred embodiment, parallel rows of crumple tubes (160) would be immediately adjacent to each other.

At the top of a plurality of crumple tubes (160) is a means for attachment to a top cover sheet (170), which, in turn, is fastened to a plurality of these crumple tubes (160). Not all crumple tubes need have this means for attachment, nor must the top cover sheet be fastened to every crumple tube that has the means for attachment. The invention only requires that the top cover sheet be attached to sufficient number of crumple tubes (160) to hold the top cover sheet (170) in place and pull the adjacent crumple tubes toward a person landing on the air bag device.

In the preferred embodiment, this means for attachment is a loop (161), typically a loop of plastic. This means for attachment is fastened to a corresponding loop (171) on the bottom of the top cover sheet (170) of the airbag device. Such fastening is typically achieved by means well known in the art, such as with a cable tie or simply a string. The crumple tubes may have any diameter and height appropriate to the application to provide a soft landing for a person landing on the device. For the preferred embodiment, the crumple tubes (160) are about 30 centimeters in diameter and about 2 meters in inflated height.

In alternative embodiments any means of attachment of the crumple tubes to the top sheet may be used instead of the loops. In one such alternative embodiment, the tops of a plurality of crumple tubes is affixed with a strip of VELCRO®, which matches a mating strip of VELCORO® affixed to the bottom of the top cover sheet.

The top cover sheet (170) ties together a plurality of the crumple tubes (160) and is itself held in place by being fastened to the crumple tubes, as described above. The top cover sheet (170) is just that, a sheet that extends across the top of the crumple tubes (160). The top cover sheet (170) does not extend around the sides of the airbag device to enclose the crumple tubes. The top cover sheet (170) being fastened to a plurality of the crumple tubes (160) joins the crumple tubes so that when a person lands atop crumple tubes, the surrounding crumple tubes lean towards the impact zone and contribute to a soft landing.

In alternative embodiments, the crumple tubes have other than a circular top view cross section, for example roughly oval, square or rectangular shapes. While the air pressure tends to shape the crumple tubes in the shape of a ball, various shapes are attained by means well known in the art, such as by welding seams to the material of the crumple tubes in the desired shape, or including internal baffles.

In one such embodiment, the parallel rows of crumple tubes of the airbag device consist of parallel rows of crumple tubes in the form of elongated walls extending across the width of the airbag device. Instead of a circular cross section, these crumple tubes have about the same width and height of the crumple tubes in the preferred embodiment and have a width extending across the width of the air bag in what is termed a "bread loaf" crumple tube. Where in the preferred embodiment section of the crumple tubes are placed in a row side by side across the width of the airbag device, in this embodiment, the row of crumple tubes are essentially connected so that in effect, the row behaves as a single horizontal crumple tube, looking somewhat like a bread loaf in cross section. Loops atop a bread loaf crumple tube are spaced about the same distance apart, as they would be in the circular cross section crumple tubes of the preferred embodiment. These loops are fastened to the top sheet in the same manner as in the preferred embodiment.

In the preferred embodiment, all of the crumple tubes are the about the same inflated height. In alternative embodiments, at least one of the crumple tubes is taller than the others. In yet other alternative embodiments, each taller crumple tubes is positioned on the airbag device so that it is a target for individuals to attempt to clear in landing on the airbag.

The base bag (150), the crumple tubes (160) and the top sheet (170) may be made of any relatively flexible airtight material, such as canvas or plastic. The preferred material is a lightweight plastic, such as polyvinyl chloride, also known as PVC.

FIG. 2 show a cross-sectional side view of the slide (200) device. The slide device is an inflatable bag (220) in the shape of a slide having a standing area (230) for a person, a slide segment (240) and a firm support (210) under the lower end of the slide segment to prevent the slide segment from deforming as a body hits the curve at the bottom.

A firm support (210) is not essential. However, a firm support (210) at the bottom is preferred to prevent significant slide deformation in the downward direction due to the weight of a moving person sliding down the slide segment (240). The firm support (210) guides the flight path of the body so that it is not altered in an unpredictable manner, pitching the participant forward onto their face. The firm support may be made with any of the traditional framing materials, such as aluminum, wood, steel, or may be provided by stiff foam rubber, or shaped air bag segments which are permanently inflated to high pressure, etc.

Air pressure in the inflatable portion (220) of the slide device must be sufficient to support a person and enable a body to slide down and fly off the end of the slide segment and free fall into the airbag device. A typical operating pressure within the inflatable portion is usually the same as the operating pressure in the base bag, which is usually greater than about 0.5 pounds per square inch gauge and preferably in the range of about 2 to 3 pounds per square inch gauge. Higher pressures may be utilized to provide greater firmness and stability of the slide device.

In alternative embodiments, the slide device is composed of more than one parallel slide segment. The parallel slide segments may also be shaped or angled differently to permit a person to choose a preferred level of excitement in the slide. Such parallel slide segments may offer different heights of free fall into the air bag device.

In yet other alternative embodiments, the inflatable portion (220) of the slide device incorporates tunnels or crawl tubes (260) with transparent panels where individuals can access (250) the tunnels from the base of the slide device and crawl through and be seen engaged in navigating the tunnels.

The slide device may have any dimension capable of meeting the requirement of a slide ending in a free fall to the airbag device. A typical dimension would be a slide segment starting at about 10 meters and ending at about 3 meters above the airbag device.

Although the description above contains many uses, these should not be construed as limiting the scope of the invention but as merely providing illustrations of some of the embodiments of this invention. Those skilled in the art to which this invention pertains will readily appreciate that numerous changes, variations and modifications can be effectuated without departing from the true spirit and scope of the invention as defined in and by the appended claims.

What is claimed is:

1. An airbag device to cushion the free fall of an individual from a height comprising, a base bag capable of sustaining an air pressure, said base bag being separated into a plurality of sections by vented baffles and wherein a plurality of breather holes at the top of the base bag permit airflow to and from the base bag;

a plurality of crumple tubes sealably attached to the base bag over said breather holes and at least two such crumple tubes having a means for attachment to a top cover sheet; and, a top cover sheet fastened to a plurality of crumple tubes.

2. The airbag device of claim 1 wherein the air pressure is above about one-half pound per square inch gauge and preferable in a range of about 2 to 3 pounds per square inch gauge.

3. The airbag device of claim 1 wherein each breather hole has a diameter above about 20 millimeters and preferably in a range of 20 to 50 millimeters.

4. The airbag device of claim 1 wherein the crumple tubes are elongated walls extending across the width of the airbag device.

5. The airbag device of claim 1 wherein the crumple tubes are at least about 30 centimeters in diameter.

6. The airbag device of claim 1 wherein the crumple tubes are all about the same inflated height.

7. The airbag device of claim 1 wherein the crumple tubes are at least about 2 meters in inflated height.

8. The airbag device claim 1 wherein at least one of the crumple tubes is taller than the others.

9. The airbag device of claim 8 wherein each taller crumple tube is positioned on the airbag device so that it is a target for individuals to attempt to clear in landing on the airbag.

10. The airbag device of claim 1 wherein the means for attachment is a loop at the crumple tubes and wherein the top cover sheet is fastened to the crumple tubes via a plurality of loops on the underside of the top cover sheet.

11. The airbag device of claim 1 wherein the means for attachment is a strip of VELCRO® affixed at the top of the crumple tubes and wherein the top cover sheet is fastened to the crumple tubes via a plurality of mating strips of VELCRO® affixed to the bottom of the top cover sheet.

12. An amusement, recreation, and entertainment slide comprising, a slide device which comprises an inflatable bag having at least one slide segment, each slide segment having a standing area for a person, each slide segment ending a distance above the ground; and an airbag device comprising a base bag capable of sustaining an air pressure, said base bag being separated into a plurality of sections by vented baffles and wherein a plurality of breather holes at the top of the base bag permit airflow to and from the base bag; a plurality of crumple tubes sealably attached to the base bag over said breather holes and at least two such crumple tubes having a means for attachment to a top cover sheet; and, a top cover sheet fastened to a plurality of crumple tubes; wherein the airbag device is positioned such that a person sliding off the end of a slide segment will free fall into said airbag device.

13. The slide of claim 12 wherein the inflatable bag has crawl tubes with transparent panels, said crawl tubes being accessible to individuals from the base of the slide device.

14. The slide of claim 12 wherein each slide segment has a firm support under its lower end.

15. The slide of claim 14 wherein the firm support is constructed from a material selected from a group consisting of wood, aluminum, steel, foam rubber and one or more bag segments permanently inflated to high pressure.

16. A process of using a slide comprising the steps of, providing a slide device which comprises an inflatable bag having at least one slide segment, each slide segment having a standing area for a person, each slide segment ending a distance above the ground; and an airbag device comprising a base bag capable of sustaining an air pressure, said base bag being separated into a plurality of sections by vented baffles and wherein a plurality of breather holes at the top of the base bag permit airflow to and from the base bag; a plurality of crumple tubes sealably attached to the base bag over said breather holes and at least two such crumple tubes having a means for attachment to a top cover sheet; and, a top cover sheet fastened to a plurality of crumple tubes; wherein the air bag device is positioned such that a person sliding off the end of a slide segment will free fall into said airbag device;

sliding off the slide device; and free falling to the airbag device.

* * * * *